US010531720B2

(12) United States Patent
Martines et al.

(10) Patent No.: US 10,531,720 B2
(45) Date of Patent: Jan. 14, 2020

(54) CONTAINER, CONTAINER COMPONENT, AND PRODUCT RANGE COMPRISING SUCH PRODUCTS

(71) Applicant: QUALIPAC, Clichy (FR)

(72) Inventors: Gérald Martines, Paris (FR); Frédéric Jouan, Bonneval (FR)

(73) Assignee: Qualipac, Clichy (FR)

( * ) Notice: Subject to any disclaimer, the term of this patent is extended or adjusted under 35 U.S.C. 154(b) by 108 days.

(21) Appl. No.: 15/542,618

(22) PCT Filed: Jan. 13, 2016

(86) PCT No.: PCT/FR2016/050050

§ 371 (c)(1),
(2) Date: Jul. 10, 2017

(87) PCT Pub. No.: WO2016/113497

PCT Pub. Date: Jul. 21, 2016

(65) Prior Publication Data

US 2017/0367460 A1 Dec. 28, 2017

(30) Foreign Application Priority Data

Jan. 14, 2015 (FR) ..... 15 50293

(51) Int. Cl.

| | |
|---|---|
| ***A45D 33/32*** | (2006.01) |
| ***A45D 40/18*** | (2006.01) |
| ***B65D 51/24*** | (2006.01) |

(52) U.S. Cl.

CPC ..... *A45D 33/32* (2013.01); *A45D 40/18* (2013.01); *B65D 51/248* (2013.01); *A45D 2200/05* (2013.01); *B65D 2203/12* (2013.01)

(58) Field of Classification Search

CPC .... A45D 33/32; A45D 40/0075; A45D 40/18; B65D 51/248

See application file for complete search history.

(56) References Cited

U.S. PATENT DOCUMENTS 5,506,612 A * 4/1996 Ogata ..... B41J 2/451 347/138
5,585,783 A * 12/1996 Hall ..... B60Q 7/00 340/473

(Continued)

FOREIGN PATENT DOCUMENTS

DE 202004013766 U1 3/2005
FR 2908502 A1 5/2008

(Continued)

OTHER PUBLICATIONS

International Search Report related to Application No. PCT/FR2016/050050 dated Feb. 29, 2016.

*Primary Examiner* — Jong-Suk (James) Lee
*Assistant Examiner* — Christopher E Dunay
(74) *Attorney, Agent, or Firm* — Miller, Matthias & Hull LLP

(57) ABSTRACT

The invention relates to a container comprising: a receptacle with an outer wall visible from outside the container the peripheral outer wall is provided with a translucent layer, a housing that defines an inner space, an electronic circuit that comprises a central light source that emits light in a main emission direction. The light source is offset relative to the translucent layer. The electronic circuit is arranged within the inner space. A wave guide is arranged opposite the light source such as to guide a light wave emitted by the light source into the translucent layer.

29 Claims, 10 Drawing Sheets

(56) References Cited

U.S. PATENT DOCUMENTS

| | | | | |
|---|---|---|---|---|
| 2003/0063460 | A1 | 4/2003 | Nadel | |
| 2004/0074513 | A1 | 4/2004 | Glndi | |
| 2004/0218402 | A1* | 11/2004 | Jao | A45D 33/32 362/555 |
| 2005/0002181 | A1* | 1/2005 | Chernick | A45D 33/32 362/136 |
| 2005/0047114 | A1* | 3/2005 | Harrell | B65D 51/248 362/101 |
| 2006/0250795 | A1* | 11/2006 | Langone | A61L 9/14 362/253 |
| 2010/0213212 | A1* | 8/2010 | Custodis | A45D 33/32 222/113 |
| 2012/0281396 | A1* | 11/2012 | Wu | A45D 40/18 362/190 |
| 2013/0032610 | A1* | 2/2013 | Muller | B05B 11/3001 222/113 |
| 2013/0105434 | A1 | 5/2013 | Levy | |
| 2013/0122817 | A1 | 5/2013 | Pivaudran | |
| 2013/0235607 | A1* | 9/2013 | Yang | F21V 33/004 362/551 |

FOREIGN PATENT DOCUMENTS

| | | | |
|---|---|---|---|
| GB | 2464526 | A | 4/2010 |
| GB | 2507293 | A | 4/2014 |
| WO | WO 2004/23850 | A2 | 3/2004 |
| WO | WO 2007/35516 | A2 | 3/2007 |
| WO | WO 2011/007113 | A1 | 1/2011 |
| WO | WO 2013/59579 | A1 | 4/2013 |
| WO | WO 2013/164641 | A1 | 11/2013 |
| WO | WO 2013/164748 | A1 | 11/2013 |

* cited by examiner

CONTAINER, CONTAINER COMPONENT, AND PRODUCT RANGE COMPRISING SUCH PRODUCTS

CROSS-REFERENCE TO RELATED APPLICATION

This Application is a 35 USC § 371 US National Stage filing of International Application No. PCT/FR2016/050050 filed on Jan. 13, 2016, and claims priority under the Paris Convention to French Patent Application No. 15 50293 filed on Jan. 14, 2015.

FIELD OF THE DISCLOSURE

The invention relates to the field of containers.

More specifically, the invention relates to the field of containers for fluid products, particularly liquids, provided with light emission means.

BACKGROUND OF THE DISCLOSURE

In mass market goods, it is becoming increasingly common to enrich the user's product experience with a light effect. This is also a possibility when the product is a container such as a bottle, a jar, or a flask of perfume, cosmetic product, or spirits for example.

Many patent documents disclose containers equipped with light systems having light-emitting diodes (LEDs). However, very few have achieved the industrialization stage. The skilled person soon realizes that fitting a container with a system providing a light effect requires a set of complex and costly solutions. In addition, many types of containers of very different shapes exist, which requires development and design for each shape in order to provide the light effect.

There is therefore a need for a more economically accessible light effect function for containers.

A description of the invention follows.

SUMMARY OF THE DISCLOSURE

According to a first aspect, the invention relates to a container. The container comprises a base portion, by means of which the container is adapted to rest on a support in a nominal configuration. The container comprises a receptacle comprising an outer wall visible from outside the container when the container is in its nominal configuration, the peripheral outer wall comprising a translucent layer.

The container comprises a housing defining an inner space.

The container comprises an electronic circuit comprising at least one central light source emitting in a main emission direction, the light source being offset relative to the translucent layer, the electronic circuit being arranged within the inner space.

The container comprises at least one waveguide arranged facing at least one light source so as to guide a light wave emitted by the at least one light source into the translucent layer.

Through these arrangements, the function of emitting light is decorrelated from the function of transmitting light in the direction of the peripheral wall of the receptacle. A dedicated system for light emission may be implemented, optimized for such emission, and a dedicated system for transmission. This results in a cost-effective implementation.

In one embodiment, the housing comprises an outer part defining the inner space.

According to one embodiment, the housing further comprises an inner part assembled to the outer part, the inner part being interposed between the outer part and the receptacle, the at least one waveguide being part of the inner part.

In one embodiment, the receptacle comprises an end wall transverse to the outer wall, and the at least one waveguide is part of the end wall.

In one embodiment, the outer part is opaque.

In one embodiment, the container further comprises at least one power source connected to the at least one light source and adapted to supply power to the light source.

In one embodiment, the power source is arranged within the inner space.

In one embodiment, the electronic circuit comprises a printed circuit board carrying the at least one light source, and the housing comprises an electrically conductive trace extending between a first portion electrically connected with a first pole of the power source and a second portion electrically connected with a second pole of the power source by means of the printed circuit board.

In one embodiment, the power source is a first power source, the container component further comprising a second power source, the second portion of the electrically conductive trace of the housing being electrically connected with the second pole of the first power source by means of the printed circuit board and the second power source.

In one embodiment, the second portion of the electrically conductive trace of the housing is electrically connected with a second pole of the second power source, the second power source having a first pole connected to the printed circuit board.

In one embodiment, the housing comprises reliefs projecting from an inner surface and laterally defining a seat for the power source.

In one embodiment, the electronic circuit comprises a printed circuit board carrying the at least one light source, and the housing comprises a resilient member adapted to bias the printed circuit board into abutment in the inner space.

In one embodiment, the resilient member is adapted to keep a power source in close contact with the printed circuit board and with a surface of the housing.

In one embodiment, the housing comprises an outer part and an inner part assembled together and defining the inner space between them, the resilient member being interposed between a base of the inner part and the printed circuit board so as to bias the printed circuit board towards the outer part.

In one embodiment, a power source is interposed, and maintained in close contact by the resilient member (12), between the printed circuit board and an inner surface of the housing.

According to one embodiment, the electronic circuit supports logic that is adapted to control at least one, in particular a plurality of, illumination sequences of the at least one light source, and is connected to the at least one light source.

In one embodiment, the logic comprises a microcontroller, and the power source is connected to the electronic circuit and is adapted to power the microcontroller.

In one embodiment, the logic is adapted to define, for each light source and in a correlated manner for at least two light sources, one or more of the following characteristics, possibly variable over time:

an illumination start time, an illumination end time, an illumination duration, an illumination spectrum, an illumination intensity.

In one embodiment, the logic comprises a microcontroller and the microcontroller is adapted to receive an illumination command from the exterior.

In one embodiment, the container further comprises a sensor system adapted to determine a parameter and to transmit a value of this parameter to the logic, and the logic is adapted to control an illumination sequence according to the value of this parameter.

In one embodiment, the sensor system comprises at least one sensor from the following list:

one or more inertial sensors adapted to detect a movement of the container, one or more capacitive sensors adapted to detect a presence near the capacitive sensor, one or more contact sensors adapted to detect a contact between two elements, in particular via a flexible tab of a printed circuit board of the electronic circuit, one or more photodetectors, adapted to detect a characteristic relating to the brightness around the container.

In one embodiment, the sensor system comprises an electrode carried by the housing, in particular by an outer surface of the housing.

In one embodiment, the electrode is electrically connected to a power source so as to be brought to a reference potential.

In one embodiment, the power source is arranged in the inner space, the electrode being electrically connected to the power source by a through-hole in a wall of the housing.

In one embodiment, the electronic circuit comprises a printed circuit board carrying the at least one light source, and the electrode is a first electrode, and the sensor system comprises a capacitive sensor comprising the first electrode and a second electrode carried by the housing, in particular by an outer surface of the housing, and electrically connected to the printed circuit board.

In one embodiment, the housing comprises an outer part, and the first and second electrodes are at least partially carried by an outer surface of the outer part, the outer part is a thin shell comprising an edge, and the second electrode is also at least partially carried by an inner surface and by the edge.

In one embodiment, the container comprises an activation system adapted to take a disabled state preventing activation of the at least one light source, and an active state permitting activation of the at least one light source.

In one embodiment, the activation system is arranged in the inner space and is mechanically inaccessible.

In one embodiment, the activation system comprises a photodetector adapted to detect a brightness level, and to change from the disabled state to the active state above a certain detected brightness threshold.

In one embodiment, the electronic circuit comprises a printed circuit board carrying the at least one light source.

In one embodiment, the printed circuit board comprises a thin substrate having a polygonal outer radial periphery, particularly regular polygonal, more particularly hexagonal or octagonal.

In one embodiment, the printed circuit board comprises a thin annular substrate having a central opening provided with a radially inner edge.

In one embodiment, the printed circuit board further comprises a tab extending into the central opening from the radially inner edge, and the tab carries a light source, in particular at the center of a circle passing through other light sources.

In one embodiment, the housing has an annular shape and a through-opening.

In one embodiment, the electronic circuit comprises a printed circuit board carrying the at least one light source, the container comprising a plurality of light sources that are distributed, in particular uniformly distributed, along the periphery of the printed circuit board particularly on one face of the printed circuit board.

In one embodiment, the container comprises a plurality of waveguides, in particular one per activatable light source.

In one embodiment, the electronic circuit comprises a printed circuit board carrying the at least one light source, the waveguides being distributed, in particular uniformly distributed, around the periphery of the printed circuit board.

In one embodiment, the waveguide opens into the translucent layer, the waveguide being adapted to direct light into the translucent layer, the translucent layer being adapted to guide the light longitudinally along its thickness.

In one embodiment, the housing is fixedly attached to the receptacle.

In one embodiment, the housing is removably attached to the receptacle.

In one embodiment, the outer wall of the receptacle comprises an outer surface having at least one opaque region and at least one translucent region.

In one embodiment, the receptacle comprises a neck extending along an extension axis, and the housing has an annular shape around the extension axis, the neck extending through a through-opening of the housing.

In one embodiment, the electronic circuit can alternatively be placed in a forced deep sleep mode, an active deep sleep mode, an active standby mode, and an active mode.

According to another aspect, the invention relates to a component specifically adapted for such a container, and comprising the above features.

According to another aspect, the invention relates to a range of such containers, comprising housings of various sizes, in particular of different lateral extensions, and electronic circuits of identical dimensions, the waveguides of different containers being different.

In comparison to the prior art, the advantages of certain embodiments of the invention are:

simplicity of implementation, versatility, good energy management, eliminating the need for recharging systems (base or connector)

high quality of the modes of interaction (initial activation, triggering a capacitor, etc.)

high quality of the light effects in the translucent wall, etc.

The implementation of spectacular light effects requires a solid understanding of the optical aspects of containers equipped with light systems. Research by the applicant shows that the quality of these effects depends heavily on the ability to place light sources in specific locations and to direct the light flow with precision, characteristics made more complex by the variety of shapes of such containers and the need to make the light systems as compact and unobtrusive as possible.

Additionally, in some embodiments, the act of offloading certain electrical functions to the trim components of the system simplifies said system, enables its miniaturization, and reduces the overall cost of implementation.

In addition, in cases where a light effect is provided for a container, there is the problem of how this effect is triggered. In many existing systems, such triggering generally requires a conscious action by the user, such as actuating a control member for example. This type of triggering is not suitable if one wants the triggering of the light effect to be unexpected. In applications in perfume, cosmetics, or premium spirits for example, which are luxury goods, one may desire an element of surprise in the triggering of a light effect, which excludes a conscious action by the user to initiate the effect. Some aspects of the invention allow providing subtle and unexpected modes of interaction, while maintaining an economically viable application.

BRIEF DESCRIPTION OF THE DRAWINGS

The figures of the drawings are now briefly described.

The following is a detailed description of several embodiments of the invention, accompanied by examples and with reference to the drawings.

In the various figures, the same references designate identical or similar elements.

DETAILED DESCRIPTION OF THE DISCLOSURE

Figure 1:
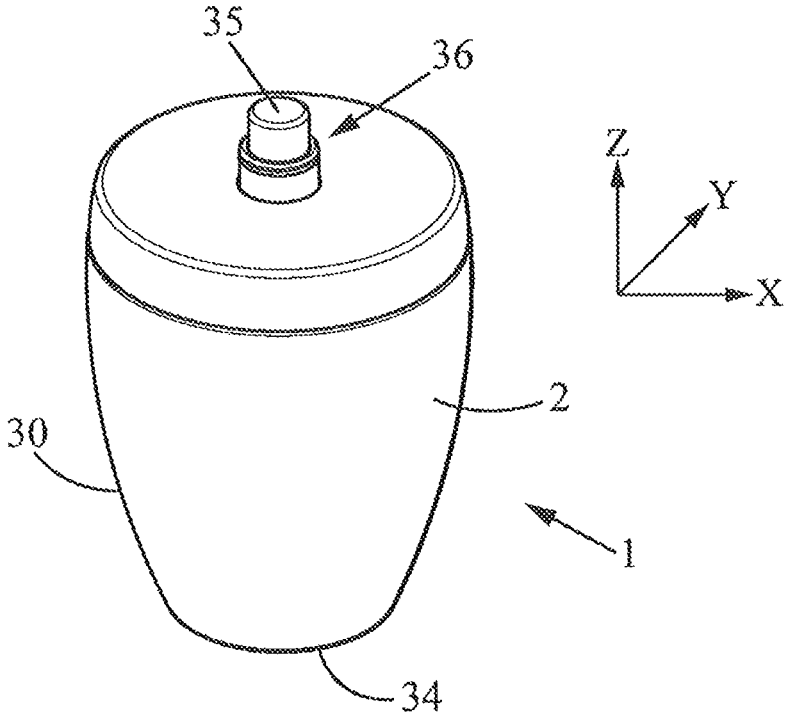
FIG. 1 is a schematic front perspective view of a container.

FIG. 1 schematically represents a container 1. In one example, the container 1 comprises a base portion 34 that enables placing the container 1 on a support, for example in a stable manner. For clarity, for illustrative purposes, one can assume a horizontal support defining an X-Y plane. The Z direction, normal to the XY plane, completes the XYZ trihedron. In the example shown, the outer surface of the container 1 is rotationally symmetrical about axis Z. This means that the X and Y directions are undifferentiated for the outer surface. This could be otherwise, however.

The container 1 extends, along axis Z, from the base portion 34 toward an opposite head portion 35. In the example shown, the container 1 has an outer surface 30 whose shape flares out slightly from the base portion 34 toward the head portion 35. It could be otherwise, however. The head portion 35 comprises a dispensing member 36. In the example shown, the dispensing member 36 is the only means by which a user of the container can access the content of the container 1. The dispensing member 36 comprises for example a pump.

The content of the container is for example a perfume. Although the invention is presented with reference to the example of a perfume bottle, the invention could be applied to other types of containers, content, and means for dispensing the content, for example a cosmetic product such as a moisturizer, serum, liquid foundation, or a spirit. Other example applications involve pharmaceutical products.

Figure 2:
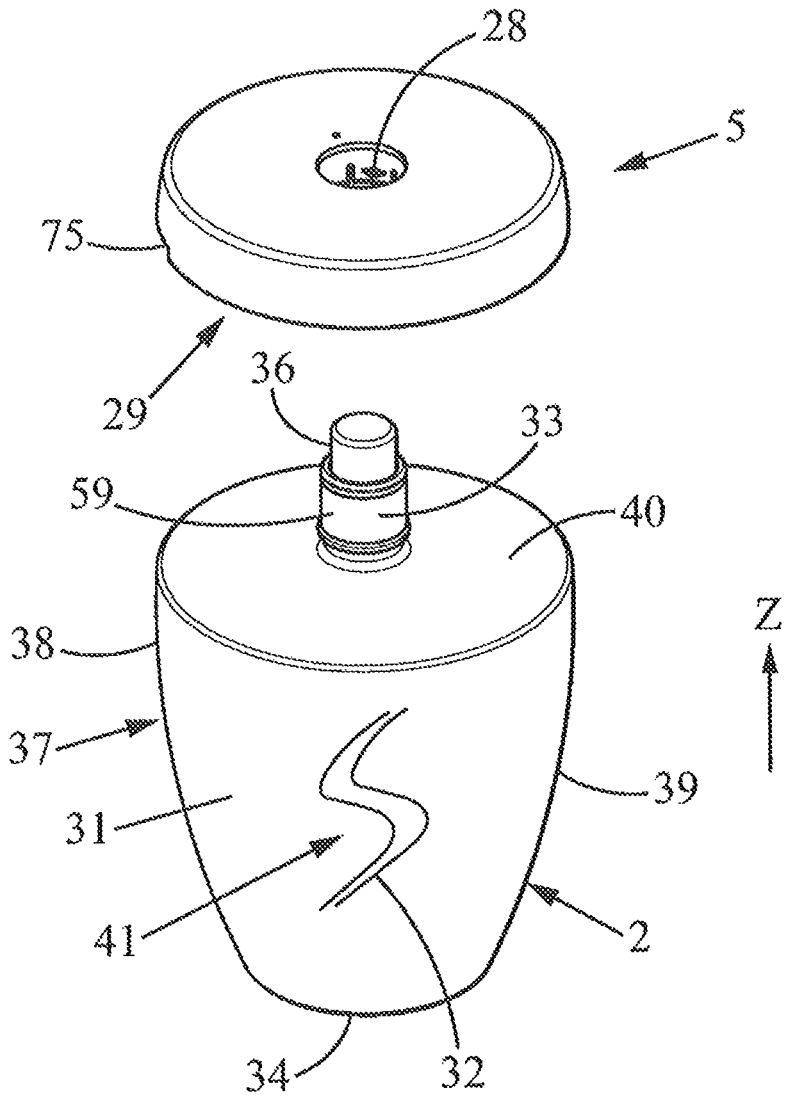
FIG. 2 is an exploded view of the container of FIG. 1, from the same perspective as FIG. 1.

As can be seen in FIG. 2, the container 1 is made of two components assembled together. In this example, the two components are assembled together permanently. During normal use of the container, the two components are therefore not intended to be separated from one another. "Permanently" is understood to mean during normal use of the container, because of course we cannot prevent a user from detaching the two components from one another if every effort is made to do so. This falls beyond the normal use of the container, however. Note that it may be desirable, in order to comply with regulations in certain countries, to be able to disassemble the container at the end of its life for recycling, particularly if it includes at least one power source, such as a button cell battery for example. This disassembly involves detaching the two components that were assembled together to form the container 1. This disassembly may require the user to make use of a common tool 78 such as a screwdriver or a knife for example, and an appropriate method which would be specified in the instructions for the product 79. This disassembly may require a notch 75 for inserting the tool 78 between the two components.

As can be seen in FIG. 2, a first component is a receptacle 2. The receptacle 2 is sealed and contains the content. The receptacle 2 comprises a body 37 to which the dispensing member 36 is assembled in a sealed manner. The body 37 comprises the base portion 34 and a body portion 38 extending from the base portion 34. The body portion 38 comprises one or more peripheral walls 39 (in the desired shape for the container 1) and a top wall 40. A neck 33 is formed in one of these two walls, in particular in the top wall 40. The top wall extends transversely to the peripheral side wall(s). The dispensing member 36 is assembled on the neck 33 in a sealed manner.

Figure 7:
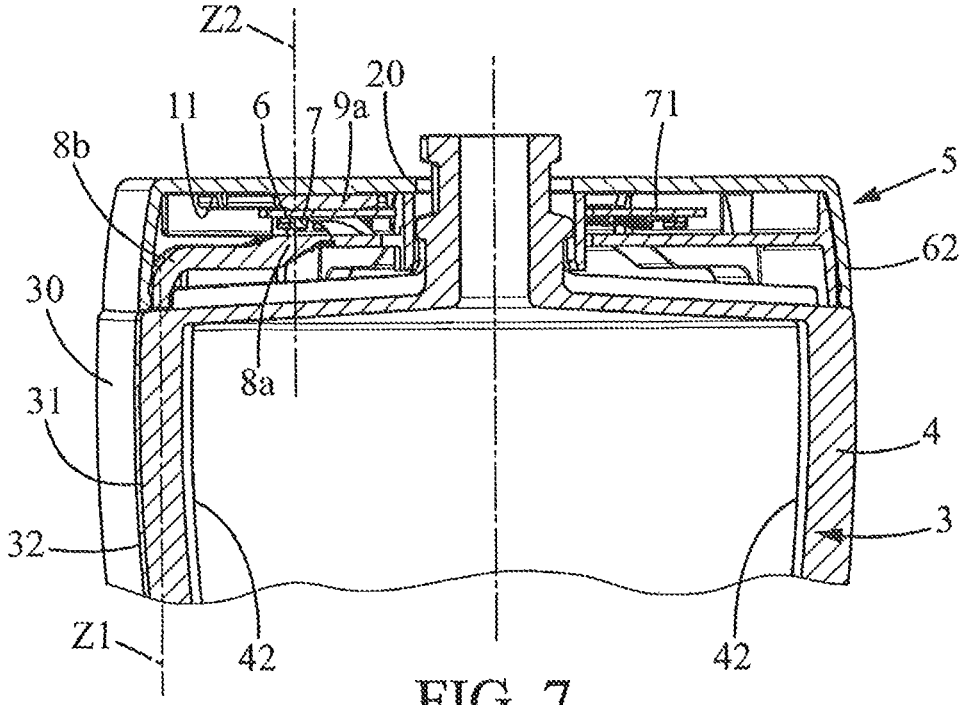
FIG. 7 is a vertical sectional front view of the container of FIG. 1.

The body 37 is made for example of glass or plastic. A material is chosen that is suitable for the application. The body 37 can thus have an outer wall 3 as can be seen in FIG. 7. This wall comprises at least one translucent layer 4. The body 37 may also present a decoration 41. The decoration 41 is provided on the outer surface 30 of the body 37, for example on the outer surface of the peripheral wall of the body 37. Such decoration 41 may for example be achieved by providing, in the outer surface 30 of the body 37, an opaque region 31 and a translucent region 32. The opaque region 31 may for example be achieved by providing an opaque material in the outer surface of the body 37 by a suitable technique. As can be seen in FIG. 7, one may also provide an opaque region 42 inside the receptacle 2. For example, an opaque substance 32 is provided on an inner face of the body 37. The opaque substance 42 is then compatible with the content of the receptacle 2.

The second component 29 comprises a housing 5 defining the outer volume of the second component 29. In the present exemplary embodiment of a container with a neck, the component 29, in particular the housing 5, may comprise an annular shape provided with an opening 28 of axis Z, for example central. The central opening 28 is sized to allow passage of the neck 33. The housing 5 has a shape complementary to the receptacle 2. In particular, the peripheral wall(s) of the housing 5 have a shape corresponding to that of the container 2. Here, for example, it therefore also has a rotationally symmetrical shape. The housing 5 may be thin. In other words, its characteristic dimension along axis Z is much less than its characteristic dimension along X and/or Y. A housing need not refer here to a fully closed product. Some openings are possible. In the case where a face of the housing is directly opposite a face of the receptacle, this face may for example have openings or only partially close off the housing 5.

Figure 3:
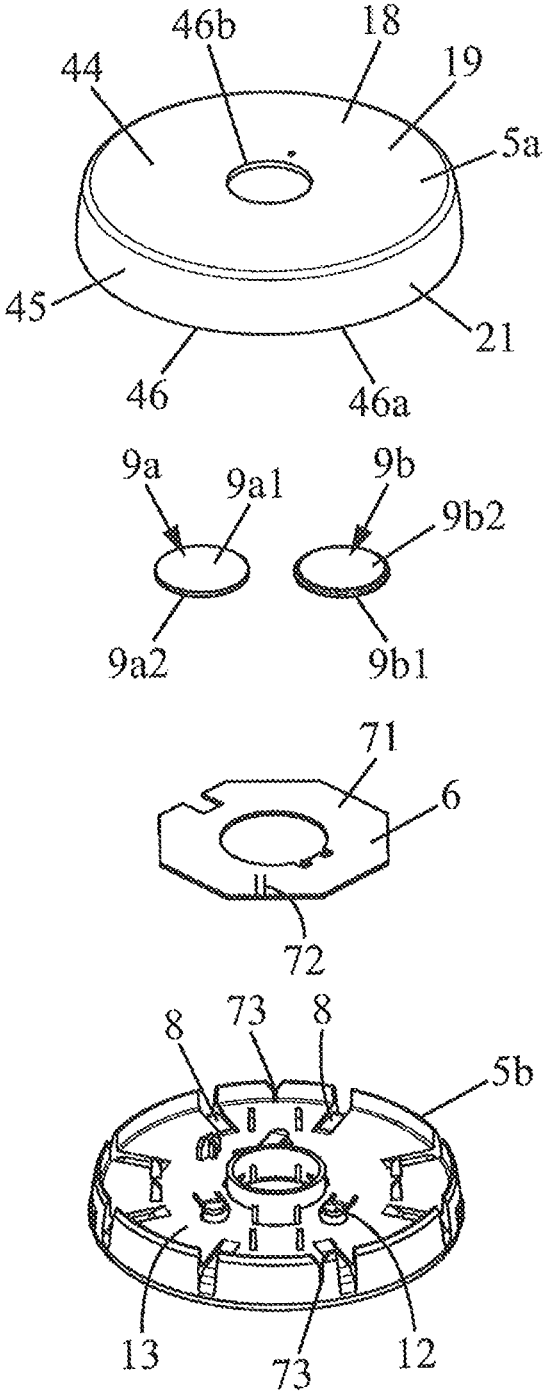
FIG. 3 is an exploded view of the container component of FIG. 2, from the same perspective as FIG. 1.

The component 29 of this embodiment will now be described in more detail, with reference to FIG. 3.

In the embodiment shown, the housing 5 comprises an outer part 5*a* and an inner part 5*b* which can be assembled together to create a closed housing. In particular, the inner and outer parts 5*b*, 5*a* are assembled by any suitable technique such as snap-fitting, welding, gluing, riveting, snap-riveting, etc. Note that it may be desirable, in order to comply with regulations in certain countries, that the housing 5 can be disassembled for recycling at the end of life of the product, particularly if it includes at least one power source in the form of a button cell battery for example. This disassembly involves separating the outer and inner parts 5*a* and 5*b* assembled to form the housing 5, in order to access the power source. This disassembly may require the user to make use of an instrument or tool, such as a knife or screwdriver, and an appropriate method may be specified in the product instructions. The outer and inner parts 5*a* and 5*b* define an inner space V between them. In particular, the housing 5 may be made to be moisture resistant. "Moisture resistant" is understood to mean a relative degree of fluidtightness to preserve the integrity and proper functioning of the internal components of the housing during normal use. Normal use of the housing may include its prolonged presence in a damp room, in particular a bathroom. Moderate fluidtightness is provided in the sense that the outer part 5*a* protects the internal components of the housing 5 against possible dripping water; in addition, the only openings in the housing 5 are those possibly formed in the inner part 5*b*; these openings are directed downward after assembly of the housing 5 to the receptacle 2, and are located in an area that is immediately opposite the top wall 40 of the container 2. This provides the inner space V of the housing 5 with relative protection from the infiltration of moist air and condensation that may occur, which is sufficient for the application.

Within the inner space V are an electronic circuit, such as a printed circuit board 6 carrying a plurality of components, and at least one (two in the present example) power source 9*a*, 9*b*. The number of power sources depends on the energy to be supplied and on the inner space V available.

In particular, the printed circuit board 6 is interposed between the inner part 5*b* and the outer part 5*a* along axis Z. The power sources 9*a*, 9*b* are interposed between the printed circuit board 6 and the outer part 5*a*.

The outer part 5*a* comprises the visible outer surface 19 of the housing. The inner part 5*b* is arranged between the outer part 5*a* and the receptacle 2. The outer part 5*a* may be opaque. It may be implemented with an aesthetically appropriate external appearance, for example by the application of varnish, lacquer, metallization, etc., and/or decorative patterns for example. The outer part 5*a* thus completely hides the electronic circuit, the printed circuit board 6, the power sources 9*a*, 9*b*, even the inner part 5*b*, from the user's external view of the bottle. The outer part 5*a* may be created as a thin shell comprising an edge 46. The outer part 5*a* comprises a top plate 44 from which a skirt 45 extends. Thus, the edge 46 is a lower peripheral edge 46*a* at the end of the skirt 45. In the case of an annular outer part 5*a*, as is the case here, the edge is also a central edge 46*b*. The part 5*a* has an inner face 11 and an opposite outer face 19.

Figure 4:
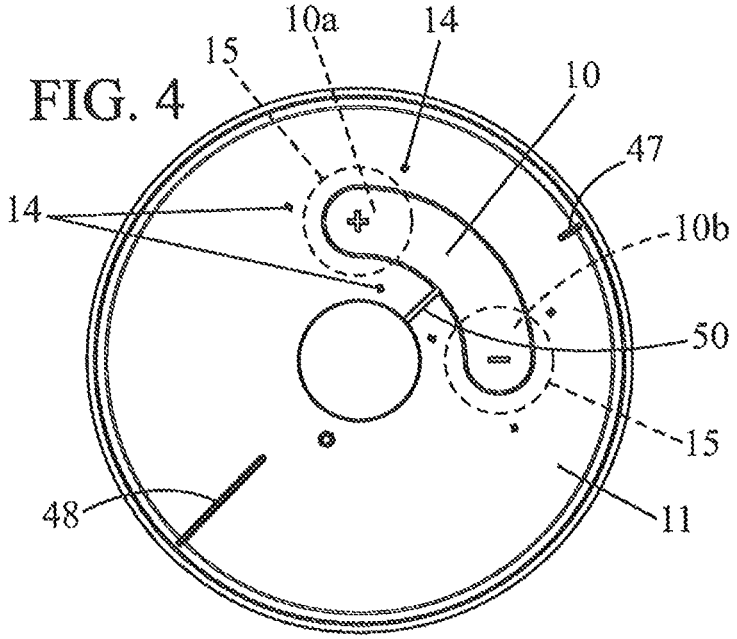
FIG. 4 is a bottom view of the outer part of the housing.

FIG. 4 shows a number of functions of the outer part 5*a*. The part 5*a* comprises a first rib 47 projecting from the inner face 11, for example from the skirt 45 or the top plate 44. The first rib 47 is part of a system preventing the relative rotation of the outer and inner parts 5*a*, 5*b* about axis Z.

The outer part 5*a* comprises a second rib 48 projecting from the inner face 11, for example from the skirt 45 or the top plate 44. The first and second ribs 47, 48 are for example substantially diametrically opposed. The second rib 48 is part of the electrical circuit as will be explained below. Here, the outer part 5*a* is made of an electrically insulating material. The second rib 48 is electrically conductive, for example by means of a conductive varnish applied to the constituent body of the outer part 5*a*.

The outer part 5*a* comprises reliefs such as spikes 14 protruding from the inner face 11 of the upper plate 44. A number of spikes (three spikes in this case) together define a seat 15 for a power source. A seat 15 is defined in the XY plane by the inscribed circle defined by the three spikes. In the present case, two different housings are defined for the two power sources. Embodiments other than spikes are possible.

The outer part 5*a* comprises a recessed peripheral groove 62 on the inner face 11 of the skirt, for example near the edge 46*a*. The peripheral groove is for example continuous along the periphery of the skirt 45.

The outer part 5*a* comprises an electrically conductive trace 10. In the example shown, a conductive trace 10 is provided that extends between the two housings 15. The conductive trace 10 thus comprises a first portion 10*a* at one seat, a second portion 10*b* at the other seat, and extends continuously between these two portions. This section of the conductive trace is therefore provided on the inner face 11 of the outer part 5*a*.

In one embodiment with a capacitive sensor, the electrically conductive trace also runs on the outer surface 19 of the outer part 5*a*. Thus, for example, the conductive trace 10 entirely covers the upper plate 44 on the outer surface 19. The conductive trace 10 does not cover all of the skirt 45 on its outer surface 19. Other geometries are possible, however.

The conductive trace 10 also comprises a connecting portion 50 interconnecting the portions arranged on the inner and outer face 11, 19 of the outer part 5*a*. This connecting portion 50 therefore passes through the edge 46*b*.

The conductive trace 10 may be created by metallization or by application of an electrically conductive varnish or ink, for example on the electrically insulating material constituting the outer part 5*a*. The characteristics of this conductive coating will advantageously be chosen such that the trace 10 has an electrical resistance of less than or equal to 2 ohms, in particular less than or equal to 1 ohm. This resistance value is chosen so as not to generate significant energy loss (heat dissipation by Joule effect) which could shorten the life of the system, and to avoid causing a significant voltage drop that could impact the operation of the electrical system.

Figure 5A:
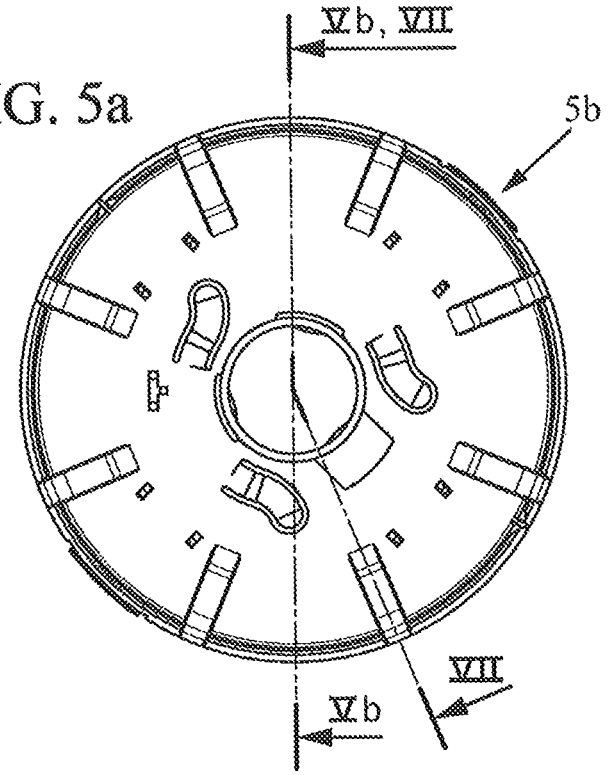
FIG. 5*a* is a top view of the inner part of the housing.
Figure 5B:
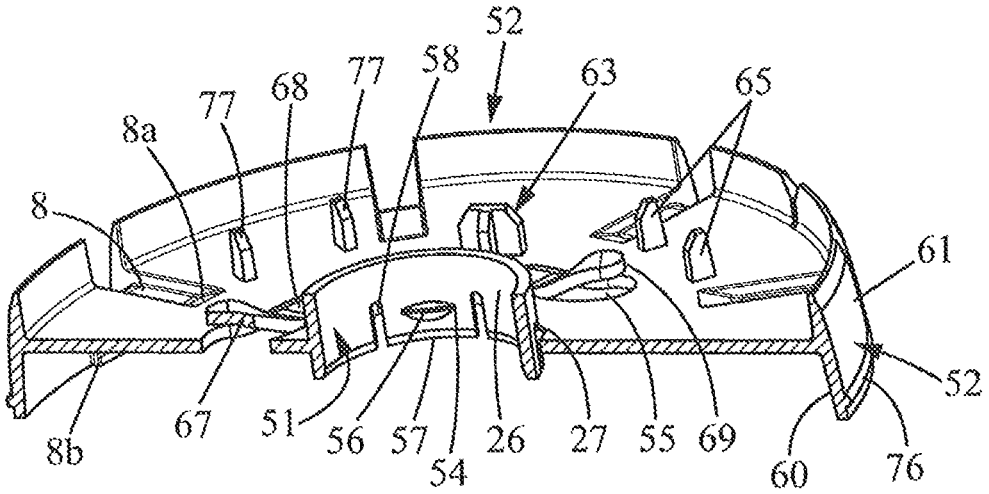
FIG. 5*b* is a perspective sectional view of the bottom part, along line V-V of FIG. 5*a*.

FIGS. 5*a* and 5*b* schematically represent the inner part 5*b* according to one embodiment.

In this example, the inner part 5*b* is substantially inscribed within the volume defined by the outer part 5*a*. It has a shape complementary to the outer part 5*a* so as to be able to be assembled therewith to define a housing having an inner space. It comprises a radially inner annular flange 51, a radially outer annular flange 52, and a plate 53 extending between these two flanges.

The radially inner annular flange 51 comprises a radially inner surface 54 and an opposite radially outer surface 27. The radially inner surface 54 is adapted to cooperate with the neck 33 of the bottle.

The housing 5 is thus mounted on the neck 33 of the bottle by this means. A snap-fitting attachment is provided for example. The radially inner annular flange 51 comprises elastically deformable fins 57, for example delimited by two parallel slots 58. The fin 57 carries a lug 56 projecting radially inwardly from the radially inner surface 54, and engaging with the neck 33 to retain the housing 5 on the neck 33. A projection 59 from the neck causes temporary deformation of the fins 57 during placement of the housing, the lugs 56 catching under the projection 59 by elastic return of the fins 57. Other embodiments are possible.

The radially outer annular flange 52 comprises a radially inner surface 60 and an opposite radially outer surface 61. The radially outer surface 61 engages with the inner face 11 of the skirt 45 of the outer part 5*a*. In particular, a bead 76 projecting from the radially outer surface 61 fits into the groove 62 formed on the inner surface of the skirt 45 of the outer part 5*a*. This bead is segmented: it is discontinuous at the arcs occupied by the optical waveguides described below, so as not to reduce their light output. Other embodiments are possible for the assembly of the inner and outer parts, for example reversing the structure of the groove 62 and bead 76.

The plate 53 comprises a number of the functions of the inner part 5*b*. It offers for example rotational indexing of the printed circuit board 6. For example, a projection 63 is provided that protrudes vertically upward from the upper surface of the plate 53 and has a shape complementary to a complementary recess 64 of the circuit board 6.

A lateral positioning (meaning in the XY plane) of the circuit board 6 is provided for example. For this, lateral positioning, pins 65 may be provided. The lateral positioning pins 65 project vertically upward from the upper surface of the plate 53. A plurality are provided on the periphery of the plate 53. They are for example provided in pairs, one pair being associated with a straight edge of the printed circuit board 6. They may comprise a chamfer 77 extending simultaneously downward and radially inward, adapted to guide the printed circuit board 6 during its assembly to the inner part 5*b* from above.

An elastic system 66 is also provided. The elastic system 66 resiliently biases the printed circuit board into position in the housing. The elastic system 66 contributes to ensuring the closure of the electrical circuit. In the example, the elastic system 66 comprises at least one resilient tab. In the present case, the elastic system comprises a plurality of elastic tabs 67 (in this case, three) that are distributed, in particular uniformly distributed, along the periphery of the plate 53. Radially, the elastic tabs are provided between the radially inner annular flange 51 and the lateral positioning pins 65. In the example shown, the elastic tabs 67 are of identical geometry but this condition is not essential; in the general case, their shape and/or position may vary, depending on the functional positioning constraints on the inner part 5*b*. They extend from a base 68 integral to the plate 53, to an opposite free end portion 69. The elastic tabs 67 are for example obtained by cutting them 55 from the plate 53. They extend primarily in the peripheral direction in the example shown.

In the exemplary embodiment, there are three contacts provided by the elastic tabs 67: one to the right of center of each cell battery and one to the right of the rib 48, which ensures electrical contact between the printed circuit board 6 and the outer part 5*a*. With these three points of support, the printed circuit board is placed in an isostatic position.

Other embodiments may require a lower number of contacts (at least two to ensure the supply of power); in this case a third elastic support may be placed at an arbitrary position, for example in a position substantially forming an equilateral triangle with the other two contacts, so as to maintain the printed circuit board in a stable position.

Other embodiments may have more than three contacts, which is not isostatic (considering manufacturing tolerances, one cannot guarantee that four or more contact points are located in the same plane). In this case, the additional contacts (more than 3) can be placed in areas of the printed circuit board which are made deformable by a local cutout forming a tab—in this case the inner part 5*b* and the circuit board 6 each comprise one or more tabs.

The plate 53 carries optical waveguides 8. A plurality of waveguides 8 may be provided. They may be identical. Eight waveguides 8 are provided for example. They extend from a first end 8*a* opening onto the upper face of the plate 53, to a second end 8*b* opening onto the lower side of the plate 53, opposite the upper face. They extend for instance essentially radially outward. The first end 8*a* is, for example, radially outward with respect to the tabs 67. The second end 8*b* is located opposite a light entry region in the receptacle. For example, it is located in a region as radially outward as possible in order to be located substantially aligned with axis $Z_1$ of the center of the thickness of a peripheral wall of the container 2. The waveguides are implemented as prisms guiding light from the first end 8*a* to the second end 8*b*. The orientation of the light in the second end 8*b* therefore depends on its orientation in the first end 8*a*. The plate 53 is arranged so that, as the first end 8*a* is facing a light source 7, the light beam emitted at the second end 8*b* is substantially along axis $Z_1$.

The waveguides may advantageously be made of a translucent material having a refractive index as high as possible, typically between 1.4 and 1.6 to maximize their ability to capture and to transmit with minimal losses the amount of light emitted by the LEDs. They may be made of plastic. They may be made of colored or colorless translucent material.

The example presented here describes an embodiment where the container is rotationally symmetrical. The waveguides are uniformly distributed on the circumference of the plate 53. In other embodiments, in which the container has another shape, the waveguides may have different shapes and be arranged in a suitable manner at the periphery of the receptacle. The number of waveguides may then be of a number suitable for the geometry of the receptacle, depending on the embodiment, for example a receptacle of polygonal shape and with a horizontal cross-section; one may have one waveguide per face of the container, or a given identical number of waveguides per face of the container.

In the example shown, the waveguides are of substantially constant cross-section; in other embodiments they may grow larger from the first end 8*a* to the second end 8*b*, which can be advantageous for distributing the light as evenly as possible along the periphery of the container.

Below, the choice of constituent material of the inner part 5*b* is discussed. The constraints for said part are the following:

for an optical component, it can be highly transparent to provide good light output, it can have a high refractive index in order to maximize capture of the flux emitted by the LEDs, it can have good rigidity and good shape memory in order to preserve the elastic properties in the elastic systems, it can have good compatibility with perfume or alcohol to prevent losing its properties in case of accidental infiltration of the product during use (the risk exists at the bottom surface, if the pump leaks for example), it can be easily implemented on an industrial scale.

As a result, the following embodiments can be considered for this part.

Materials of the styrene, acrylic, copolyester, vinyl, ionomer, and polycarbonate families are suitable.

For the families of polymeric materials listed above, the refractive indices range from 1.49 (similar to glass) to 1.58. Polycarbonate has the highest refractive index, at 1.58.

Acrylics, polycarbonates, and copolyesters offer good rigidity and good shape memory. The other listed materials tend to be reshaped under stress and lose their elasticity.

Copolyesters and polycarbonates have acceptable chemical resistance. Ionomers are best for this criterion.

All these polymer families offer acceptable capabilities. Polycarbonate is the most difficult to utilize.

Depending to the intended application and the relevance of the various requirements listed above, the material with the best compromise for the application is chosen.

The choice considered optimal for the embodiment presented is polycarbonate, and the second choice is the copolyesters. Depending on the compromise to be made for the various functions of the part, other materials may be considered to be preferred.

The inner face of the housing comprises the inner faces of the outer and inner parts. The outer face of the housing comprises the outer faces of the outer and inner parts.

Figure 6:
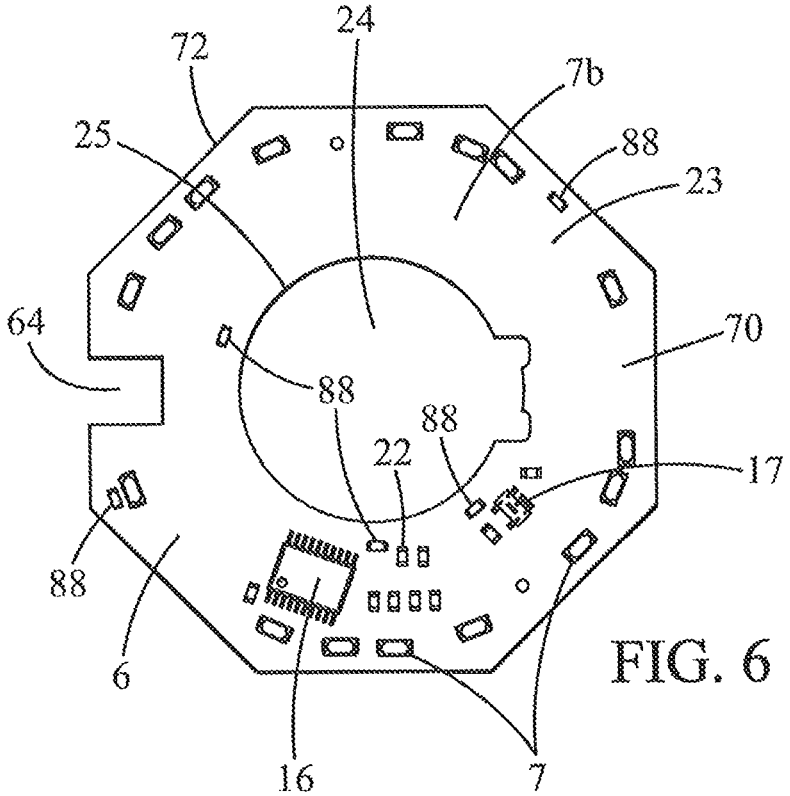
FIG. 6 is a bottom view of an exemplary printed circuit board.

FIG. 6 represents a printed circuit board 6, and in particular the lower face 70 of the printed circuit board 6, according to one embodiment. The printed circuit board 6 comprises a thin substrate 23 and traces (not shown) electrically interconnecting the various electronic components. The printed circuit board 6 has a shape suitable for the application. In particular, in the present example it can have an annular shape with a central opening 24 bounded by an inner edge 25. The inner edge 25 is sized for threading with clearance onto the base 26 provided for this purpose in the housing 5, here created by the radially outer surface 27 of the radially inner annular flange 51 of the inner part 5*b* of the housing 5.

The printed circuit board also has a notch 64 of a shape adapted to cooperate with the complementary projection 63 from the inner part 5*b*, for rotational indexing.

The peripheral edge of the printed circuit board 6 may have a polygonal shape (excluding the notch 64). For example, a shape covering the plane, or close to covering the plane, is chosen. For example an octagonal shape is chosen, as represented. The printed circuit boards 6 can thus be manufactured in series, cut from a panel of large dimensions without significant loss of material when cutting, and be particularly suited to container shapes which conventionally are rotationally symmetrical.

The electronic circuit comprises circuit logic. In the example shown, the printed circuit board 6 carries a microcontroller 16. The microcontroller 16 can be preprogrammed to carry out certain functions, as will be explained below. However, other types of embodiment for the circuit logic are conceivable. The printed circuit board 6 may also carry a voltage regulator, for example when using two or more batteries in series. The printed circuit board 6 carries light sources 7. Light-emitting diodes (LEDs) 7 are chosen for example.

LEDs have several advantages for the illumination of bottles and jars for cosmetics and spirits:

very small size, which allows placing them in a small housing 5 and provides the possibility of creating light sources that are very isolated or that have any desired shape by combining a plurality of LEDs;

low to very low power consumption (tens of milliwatts);

good performance, therefore very little heat loss, which reduces the risk of plastic deformation of the housing components due to heat, and allows optimization of the energy requirements, therefore of the size of the batteries to be embedded for a given service life and level of illumination;

many available colors;

simple to mount on a printed circuit board;

operation at extra-low voltage (ELV), guarantee of safety and ease of transport.

Each LED can alternate between an active state in which it emits light, and an inactive state in which it does not emit light. The microcontroller 16 is programmed to control the triggering of the LEDs. The microprocessor can thus trigger the transition of the LEDs from their inactive state to their active state. In their active state, the LEDs can be controlled by pulse-width modulation (PWM). In the example, the LED emits a beam of light along axis $Z_2$ normal to the surface 70 of the printed circuit board supporting the LED.

The microcontroller 16 can define, for each light source 7, and in a correlated manner for at least two light sources 7 or even all the light sources, one or more of the following characteristics, possibly variable over time:

an illumination start time, an illumination end time, an illumination duration, an illumination color (or spectrum), an illumination intensity.

The LEDs are arranged on the lower face of the printed circuit board 6. The LEDs are said to be "central", as opposed to the outer wall 3 which is "peripheral". This means that the LEDs generally lie closer to a central region of the container than the peripheral wall. Therefore, the waveguides extend at least partially radially outward from the LED to the peripheral wall. The LEDs able to be placed in an active state are arranged facing the first end 8*a* of a corresponding waveguide. In particular, the LEDs 7 and the waveguides 8 are arranged so that a major portion of the light emitted by the LED enters the corresponding waveguide 8. For example, there are as many LEDs 7 as there are waveguides 8. The LEDs 7 are arranged for example as far as possible radially from the center of the printed circuit board 7. In particular, in the case of a polygonal printed circuit board, a LED is positioned on a circle of a slightly smaller diameter than that of the circle inscribed in the polygon concerned. The surface of the printed circuit board is thus optimized, and the central space is available for placing the other electronic components and the conductive traces. The LEDs are mounted in some of the large number of pre-wired locations. The selection of pre-wired locations depends on the chosen implementation. The pre-wired locations are defined such that a small number of pre-wired locations allows defining a wide variety of possible geometries for the printed circuit board. For example, sixteen pre-wired locations are provided (visible in FIG. 6) arranged so as to define uniformly distributed arrangements of two, three, four, five, six, and eight light sources. Thus, the printed circuit board may alternatively comprise two, three, four, five, six, or eight LEDs, without changing the shape or the architecture.

The electronic circuit may also comprise a sensor system 17. The sensor system 17 is adapted to detect an event and to transmit information about the event to the microcontroller 16. The sensor system 17 comprises for example an inertial sensor carried by the printed circuit board, adapted to detect a movement of the printed circuit board 6 (due to a movement of the container carrying it). Alternatively, the sensor system 17 may comprise a contact switch for detecting a state change of the system such as the opening or closing of a lid. Alternatively, the sensor system may comprise a light detector, such as a phototransistor or a photodiode for example, which can for example detect a change of state of the device by light detection: for example, the light detector may be placed at the end of a waveguide whose other end leads to a suitable location that is covered or uncovered depending on the state that is to be detected. Different pre-wired locations 88 for a phototransistor are provided on the printed circuit board in order to have at least one suitable location for most applications. In another variant, the sensor system 17 may comprise a capacitive sensor, whose operation will be described below.

The change of state of a sensor is transmitted to the microcontroller 16 which can command a pre-programmed light effect accordingly.

The printed circuit board 26 may also carry an activation system 22, which will be explained in detail below.

The components were described above as being provided on a face of the printed circuit board 6. Alternatively, some components could be provided on the opposite face and electrically connected with the rest of the circuit by metallized through-holes.

The upper face 71 of the printed circuit board 6 comprises at least one conductive trace in contact with a power source 9*a*, 9*b*. Thus, in one embodiment, the power source is in direct electrical contact, without connector, with the printed circuit board and with the housing.

In one embodiment with a capacitive sensor, the upper face 71 of the printed circuit board 6 also comprises at least one conductive trace 72 in electrical contact with an electrode carried by the outer part 5*a*.

As explained above, the outer part 5*a* has an electrode 18 on the outer face of the outer part, and electrically connected with the conductive trace 10 on the inner face 11.

The outer part 5*a* also comprises a second electrode 21 electrically isolated from the first electrode 18 and close to the latter. The second electrode 21 extends at least partially over the outer face of the outer part. For example, it covers the outer face of the skirt 45. It also extends at least partially over the inner face 11, electrically connected with the outer face via the edge 46*a*. On the inner face, it extends for example over the rib 48 in contact with a conductive trace of the printed circuit board 6. The two electrodes have any desired geometry on the outer face of the housing, for example a ring surrounded by another ring or interleaved combs. A capacitive sensor is implemented with a detection electrode 21 and a reference electrode 18 which are brought to two different potentials. A change in capacitance between the two electrodes that is due to a change near the electrodes is detected, in particular by the nearby presence of part of the human body (a finger).

Each power source 9*a*, 9*b* comprises a first pole 9*a*1, 9*b*1 and a second pole 9*a*2, 9*b*2 opposite to the first pole. The first poles have the same polarity.

The two power sources 9*a*, 9*b* are connected together, for example in series. The voltage across the generator is thus the sum of the individual voltages supplied by the power sources 9*a*, 9*b*. A simple series circuit can be achieved by mounting the two power sources head to tail, so that a first pole 9*a*1 of the first power source and a second pole 9*b*2 of the second power source are in contact with the conductive trace 10.

The power sources are button cell batteries for example, which have a footprint and energy supply suitable for the present embodiment.

FIG. 7 represents the assembled system.

The printed circuit board 6 is arranged on the inner part 5*b*. The printed circuit board is arranged with its side carrying the LEDs turned towards the inner part 5*b*. The orientation about the Z axis of the printed circuit board 6 is defined by the engagement of the pin 63 and the notch 64, forming a rotational indexing system. The peripheral edge 72 of the printed circuit board engages with the lateral positioning pins 65 (with the inner edge 25 of the printed circuit board threaded around the radially outer surface 27) of the inner part 5*b* to define the lateral positioning of the circuit board 6. In this position, the printed circuit board 6 rests on the free end portions 69 of the elastic tabs 67. The LEDs are located next to the inlets 8*a* to the waveguides 8.

The outer part 5*a* is assembled to the inner part 5*b* to close the housing 5 and define the inner space V, with the power sources 9*a*, 9*b* mounted in the correct orientation in their respective seats defined by the spikes. The orientation of the outer part 5*a* relative to the inner part 5*b* is defined by a rotational indexing system. For example, the radially outer annular flange 52 comprises a slot 73 engaging with the rib 47. The housing 5 is closed for example by snap-fitting, the bead 76 and the groove 62 retaining the inner part 5*b* to prevent an unwanted release.

With the housing closed, the elastic tabs are compressed and they bias the printed circuit board 6 in the direction of the outer part 5*a*. The power sources 9*a*, 9*b* are clamped between the circuit board 6 and the outer part 5*a* by the action of the tabs, held in contact with the conductive trace 10 provided on the inner face of the outer part 5*a*. Good electrical contact is thus maintained. The spikes 14 laterally retain the power sources 9*a*, 9*b* in the seats 15.

The microcontroller 16 is thus powered by the two power sources 9*a*, 9*b* in series via a connection through the outer part.

Due to the closed circuit, the first electrode 18 is placed at an output potential of one of the power sources 9*a*, 9*b* serving as a reference potential. The second electrode 21 is connected to the printed circuit board 6 for placement at another potential. The electrodes may be implemented for example by providing a conductive area extending over the outer part 5, and performing etching by laser ablation for example, of a line positioned for example on the edge between the plate and the skirt 45, to isolate the areas intended to be placed at different potentials. On the outer face, the electrodes are encapsulated in an insulating varnish to protect and hide them. On the inner face, they may be coated with an electrically conductive varnish to enhance their electrical properties and prevent wear from contact with the printed circuit board.

One can create as many detection electrodes as desired, each connected to a respective input terminal of the microcontroller, which allows detecting multiple types of event or detecting the position of user contact on the housing 5, in order to trigger appropriate actions.

In practice, it is sufficient to cut out as many areas as desired and connect them to the same number of ribs and contacts on the printed circuit board.

The housing 5 is then assembled to the receptacle 2, as explained above, to form a container 1. As can be seen in particular in FIG. 7, the skirt 45 and the second end 8*b* of the waveguide 8 are in the axis of the transparent wall. Axis $Z_1$ where the light beam enters the receptacle is laterally offset from axis $Z_2$ where the light beam enters the waveguide. The dispensing member 36 can be assembled to the neck 33 either before or after the assembly of the housing 5.

The precise positioning of the printed circuit board 6 relative to the inner part 5*b* ensures proper entry of light into the waveguide. The precise positioning of the inner part 5*b* relative to the receptacle ensures proper entry of light into the receptacle.

In particular, the exit portion 8*b* of the waveguide 8 is opposite a light entry region of the receptacle. For example, it is oriented so that it emits a light beam that is locally parallel to the translucent layer 4.

As explained above, in this embodiment, the recharging or replacement of power sources is not intended. Therefore, the technological part of the product is completely hidden to the user. The power sources and LEDs (number, consumption, brightness, threshold voltage) are then chosen so that the power sources are sufficient to supply the container for its presumed service life (based on the content volume, assuming it to be non-refillable).

A low number of LEDs may cause parasitic bright spots, but will result in lower power consumption.

Power consumption by the LEDs is obviously a factor in the type of light effects that can be offered (duration in particular), and in the life of the product.

Maximum brightness may be useful for some light effects, but is not necessarily desired.

The lowest threshold voltage can extend product life when the power sources only provide a low voltage. However, as the threshold voltage is related to the emission spectrum of the LED, choosing the lowest threshold voltage entails a huge compromise in terms of light effects that can be generated. White LEDs, providing the greatest possibilities in terms of light effects, have a higher threshold voltage.

However, alternatively, a removable assembly of the outer part to the inner part may be provided in order to enable replacing the power sources, or any other mode of access to the power sources, for example such as a door or a connector to a charging system for the power sources which are then rechargeable.

The container comprises an activation system 22. The activation system 22 is adapted to alternate between a disabled state preventing the activation of the at least one light source 7, and an active state permitting the activation of the at least one light source. Such an activation system can prevent the consumption of power before the user acquires the container. The packaged container will be moved and is close to its packaging 80, such that the inertial or capacitive sensors may trigger an undesired emission of light while the container is still packaged. The activation system 22 may be of particular interest in cases where the power sources 9*a*, 9*b* are not replaceable or rechargeable.

The activation system 22 may for example comprise a pushbutton switch actuated by a user when the container is first used.

Alternatively, the activation device may comprise an activation tab. In its inhibiting state, the activation tab prevents for example any electrical contact of the power sources with the electric circuit of the printed circuit board 6. For example, the activation tab is made of an insulating material. The tab has a portion partially projecting from the container via the housing 5, and an opposite portion that is inserted between the power sources and the electrical circuit of the printed circuit board 6. The user must pull on the projecting portion of the activation tab to disengage the activation tab from the container, placing the power sources 9*a*, 9*b* of the container in electrical contact with the other electronic components of the container via the traces of the printed circuit board 6.

Alternatively, an activation system 22 may be provided that involves no mechanism accessible from the exterior, which makes it easier for the user to make use of the container. In this case, the activation system 22 is placed in the disabled state just before the container is placed in its packaging. For example, the activation system 22 itself comprises a switch which is activated during assembly of the housing 5, or the microcontroller may be programmed into standby mode at the time of assembly. The activation system 22 is adapted to detect a level of light intensity in the inner space, checking infrequently (for example once per hour). The threshold level is selected so that the light intensity in the inner space V of the housing is below the threshold level when the bottle is in its packaging 80, but above it when the bottle is removed from its packaging (in a lit room). Thus, when unpacking the bottle, one must wait a certain amount of time until the activation system 22 performs its periodic polling and detects a light intensity above the threshold in the inner space, and then changes to the active state. In the active state, the operation described above is allowed.

Figure 16:
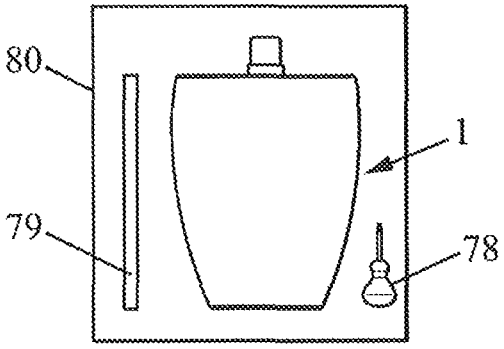
FIG. 16 schematically represents the commercial kit comprising the container.

FIG. 16 shows the container 1 packaged in its packaging 80 with the user guide 79 and, if necessary, the tool 78.

Once the system has changed to its active state, one or more pre-programmed light sequences can be emitted. Many variants are possible.

A light sequence means a series of commands for one or more LEDs to emit light, this emission possibly lasting for a period of time, possibly pulsing periodically, the LEDs treated in the same manner or differently, the color and intensity being fixed or changeable over time, etc.

The electronic circuit may include a timer. The timer may for example comprise a quartz-based crystal oscillator operating in the megahertz or kilohertz range. The timer is operatively connected to the other electronic components of the container, in particular the microcontroller 16. The timer may be supported by the printed circuit board 6. The timer ensures the switching on or off of the light sources 7, for example in accordance with predetermined data stored on a storage medium of the container.

For example, the microcontroller can spontaneously control a light sequence, periodically and/or randomly.

Additionally or alternatively, the microcontroller can order a light sequence upon detection of an event by the sensor system 17. The sensor system will then send an appropriate parameter to the microcontroller. Such an event will be for example a movement of the container 1, indicating that a user is going to use and/or has just used the container 1.

Such an event will be for example a detected change in capacitance between the two electrodes 18 and 21, indicative of the nearby presence of something which, in most cases, is the user's finger.

Figure 8:
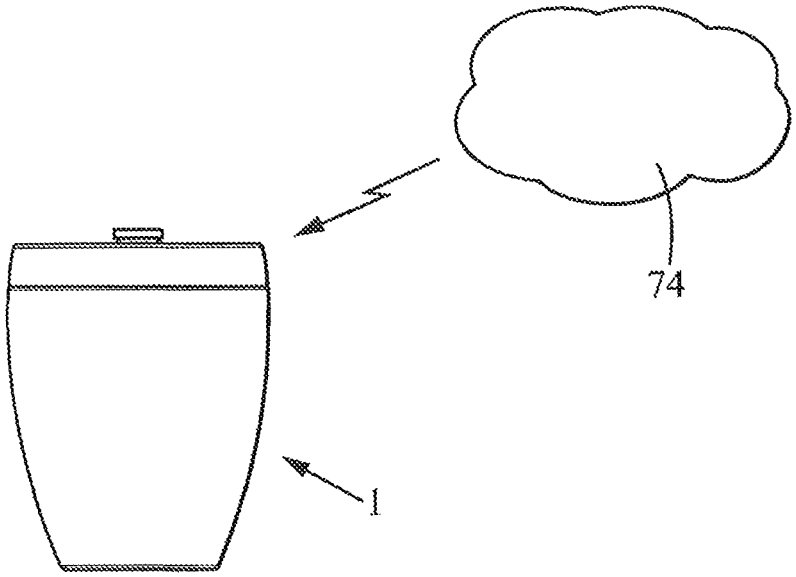
FIG. 8 is a schematic view of a use of the container.

In another variant, the microcontroller can receive a command from the outside. In particular, as represented in FIG. 8, the microcontroller can receive a command from a remote server via a telecommunications network 74.

In one example, the system may be in a number of more or less active states as described below, which each generate a higher or lower level of consumption:

"Forced deep sleep" mode: in this mode the essential functions of the microcontroller are disabled, except for a dedicated clock (for example a very low power oscillator (VLO)) which remains operational, and a small program portion that tells the processor to wake up and change to active deep sleep mode (described below) for example after a predetermined time T1—the processor is programmed to be placed in this mode just after the final inspection on the assembly line.

"Active deep sleep" mode: in this mode, most of the microcontroller functions are also disabled except the dedicated clock, and a small program portion (different from the one for forced deep sleep mode) that tells the processor to wake up at specified intervals to test the state of the activation sensor (light sensor). This test is conducted for example at a frequency P1. If the processor detects that the light sensor has exceeded the specified brightness threshold, the system goes into "active standby" mode (defined below), otherwise it remains in active deep sleep mode.

"Active standby" mode: in this mode, the functions of the microcontroller are active, and the processor tests the state of the sensor or sensors 17 at specified intervals to detect whether the user is handling the system. This test is conducted at a frequency P2: if the processor detects a user action, via the state of the sensor or sensors 17, the system changes to "active" mode (defined below), otherwise it remains in "active standby" mode. Where required, after a predetermined time in "active standby" mode, it returns to "active deep sleep" mode.

"Active" mode: the microcontroller executes a specified sequence corresponding to the state of the sensor or sensors 17.

Figure 9:
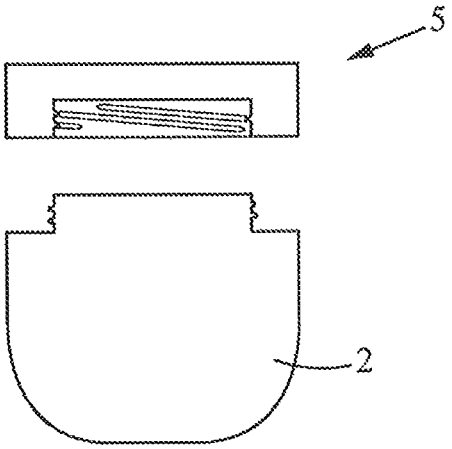
FIG. 9 is a schematic view of a container according to a second embodiment.

In the above embodiments, the component 29 is permanently assembled to the receptacle 2. However, in an alternative as represented in FIG. 9, it may be detachably assembled. The receptacle 2 may then comprise a large opening for accessing the content. A system for assembling the component 29 to the receptacle 2 by screwing or bayonet insertion may be provided for example.

Alternatively, the system could be placed in the cap of a bottle of perfume (small sized opening), or in a stopper of a bottle of spirits.

In these specific cases, a lighting shutoff control may be provided for when the container is open, in order to disable the lighting function after separation of the component 29 from the receptacle. For example, a suitable use of the timer is provided, or a combined system in which the capacitive sensor triggers the lighting when contact with the jar is detected, and the inertial sensor shuts off the lighting when motion is detected. Additionally or alternatively, the component 29 may also include a light detector, for example a photodiode or phototransistor which can, for example, detect the separation of the component 29 from the receptacle by light detection: for example the light detector may be placed at the end of a waveguide whose other end leads to a carefully chosen location that is covered or uncovered depending on whether the component 29 is in the assembled or disassembled state. In another alternative, a contact sensor is used which detects contact between the component 29 and the receptacle 2.

Alternatively, one could place the electrodes on the inner face of the outer part, thereby reducing production costs and simplifying the creation of decorations on the outer face of the outer part, while maintaining a detection sensitivity consistent with the application.

Alternatively, the outer part 5*a* could be implemented in a conductive metal such as aluminum or zinc alloy for example, and insulating areas created at the desired locations by application of a varnish or an insulating ink. In this case, the entire outer part 5*a* constitutes the detection electrode (in cases where the sensor is a capacitive sensor), and the reference antenna 5*b* could be implemented on the inner part or on a region of the receptacle 2.

Alternatively, illumination is ordered after use of the container (when the inertial sensor and/or the capacitive sensor detects nothing for a predetermined time after detection of an event or the light detector or contact sensor once again detects the assembled state).

Figure 11:
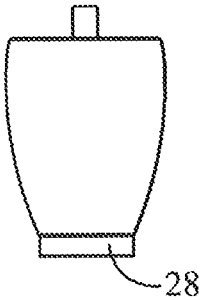
FIG. 11 is a schematic view of another embodiment.

Thus, although the embodiment described above provides an annular housing 5 mounted around a neck, alternatively there could be no central opening 28. This is the case for example with a component that can be removed from the receptacle, as explained above in connection with FIG. 9. Alternatively, as represented in FIG. 11, the component 29 may be arranged at a lower level of the container 1, for example.

Figure 12:
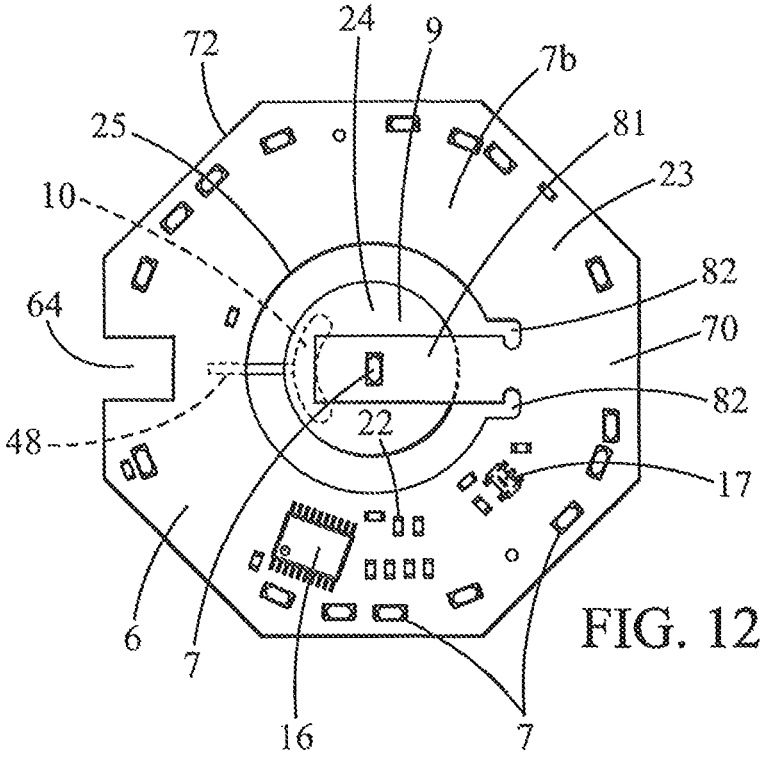
FIG. 12 is a view similar to FIG. 6, for a printed circuit board suitable for the embodiment of FIG. 11.

FIG. 12 schematically represents the implementation of one possible component for these embodiments. In this case, the printed circuit board 6 is not necessarily annular. In the embodiment shown, it comprises a tab 81 which extends from the radially inner edge 25. The tab may have one or more locations for LEDs 7 which are controlled by the microcontroller as the others are. The LEDs 7 may not all be intended to emit a beam of light into the translucent layer 4. Some of the LEDs 7 may directly illuminate the product contained in the receptacle or may be arranged to provide a light effect at the surface of the housing 5. For example, a LED 7 is provided that is central if the receptacle 2 has a rotationally symmetrical cross-section, or is central relative to the printed circuit board 6.

In this embodiment, the power source 9 may also be centrally positioned. This case corresponds for example to a jar lid, where the batteries would be placed as far inside as possible in order to reduce the total diameter of the lid. Conversely, in such an application there would be no central hole to fit around the neck of a bottle, and this freed space can then be put to use. For example a single power source 9 is used, or several which are centrally stacked. The printed circuit board 6 thus comprises a conductive trace at the tab 81, for electrical contact with the power source 9. The conductive trace 10 of the outer part 5*a* is schematically represented in FIG. 12, and extends from a portion in contact with the power source 9 to a rib 48 in contact with the printed circuit board 6, in order to close the electrical circuit. The other elements of the outer part 5*a* are not represented.

The tab 81 may be implemented as a snap-out portion formed in the central hole of the printed circuit board. With these arrangements, a single circuit board is created, and; for annular applications, one simply breaks off the snap-out tab 81. One will note the notches 82 which form predefined break lines for the tab 81. This point is part of the versatility of the circuit board.

In other embodiments, one may wish to have two or more power sources in series stacked atop one another, or two or more power sources in parallel, or a single power source. In all three cases, the closed electrical circuit cannot pass through the power sources as with the first example described. In this case, the conductive trace 10 is extended by a rib (similar to rib 48), coated with a conductive coating to ensure electrical continuity with the trace 10 and in contact with an electrode provided for this purpose on the printed circuit board, which closes the electrical circuit.

Figure 13:
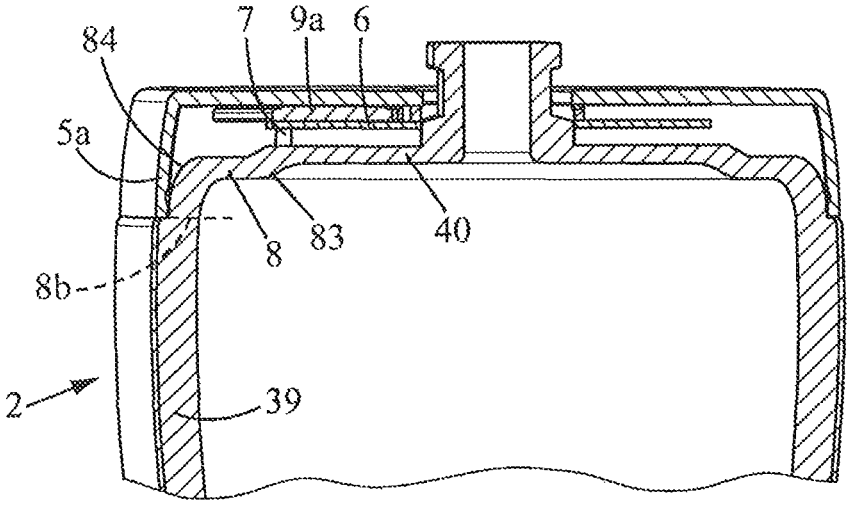
FIGS. 13, 14, 15, 17, and 18 are schematic views similar to FIG. 7 for other embodiments.

FIG. 13 represents another embodiment, where the housing 5 does not comprise an inner part 5*b*. The inner space V is then defined as the volume between the outer part 5*a* of the housing 5 and the top wall 40 of the receptacle 2. In this case, the waveguide 8 is created directly in the top end wall 40 of the receptacle 2. The vertical cross-section of the waveguide 8 has for example a shape approximating that of the waveguide 8 presented above formed in the inner part 5*b*. Thus, a first reflective bend 83 is provided to direct light from the LED 7 radially outward, and a second reflective bend 84 is provided to direct light parallel to axis $Z_1$. There is no optical interface at end 8*b*, the latter being integral with the peripheral wall 39. This embodiment can be considered for the case of a non-removable housing 5, in which case the top wall 40 protects the electronic components.

Figure 14:
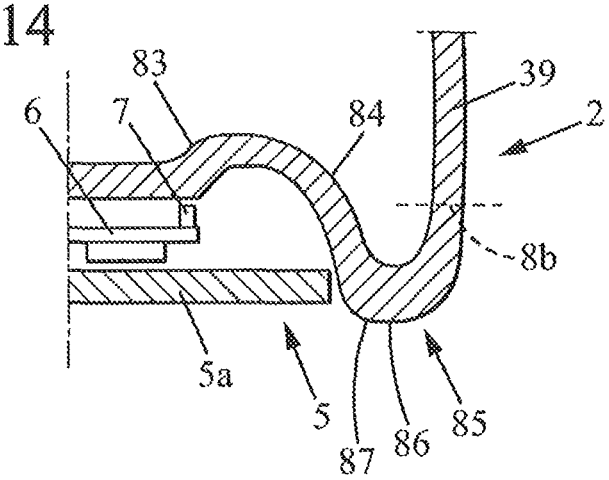

Such an embodiment is also conceivable for the case where the housing 5 is arranged in the bottom of the container 1, as shown in FIG. 11 and partially in FIG. 14. In FIG. 11, the housing 5 may comprise the base portion of the container, and have a contact sensor adapted to detect contact with the support of the container and to transmit this information to the microcontroller. In FIG. 14, the housing 5 is retained in an inner space defined by a peripheral rib 85 of the receptacle 2. The housing 5 is assembled in any suitable manner, for example by snap-fitting or gluing. In this embodiment, one will note the particular shape of the waveguide 8 formed in the bottom end wall 86 of the receptacle 2, and guiding the light into the peripheral wall 39.

One or more additional reflective bends 87 may be necessary.

The reflective bends may be implemented by localized treatment of the receptacle 2 in order to provide the desired optical characteristic in that area. On the inner surface of the receptacle 2, it will be easier if the receptacle 2 has a wide opening to allow the passage of treatment equipment.

Figure 15:
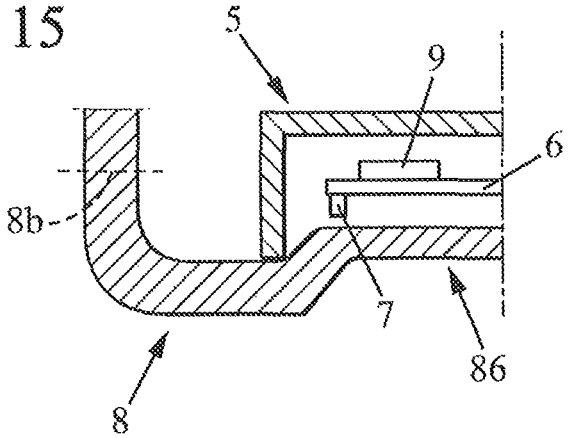

Such an embodiment is also conceivable for the case where the housing 5 is arranged inside the receptacle 2, as shown partially in FIG. 15. In FIG. 15, the housing 5 is assembled in any suitable manner to the receptacle, in a sealed manner relative to the content. The housing 5 is assembled for example to the bottom of the receptacle 2, but other locations are possible. The waveguide 8 has a first reflective bend similar to that of FIG. 7, but also a second reflective bend opposite to that of FIG. 7, to guide the light upwards in the peripheral wall.

Figure 17:
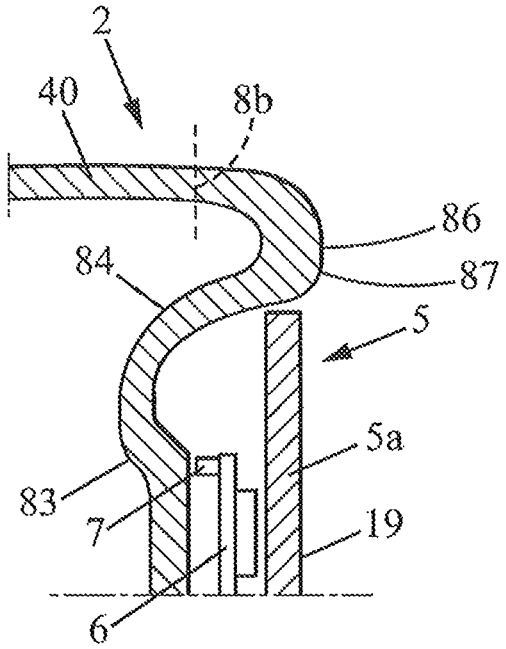

Alternatively, as represented in FIG. 17, the light system may be placed on a side wall of the container 2. The outer part 5*a* can then form a decorative plate, such as a rigid label.

Figure 18:
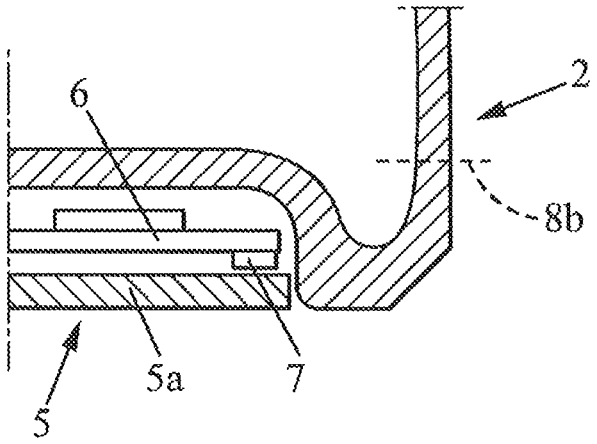

As represented in FIG. 18, alternatively, in certain applications, one may use LEDs 7 which emit light along an axis parallel to their plane of placement, in other words the plane of the printed circuit board 6. Some applications could benefit from such LEDs emitting light parallel to the plane of the circuit, which could allow reducing the thickness of the housing 5, particularly in the case of circuits accommodated in the bottom of a container.

Figure 10:
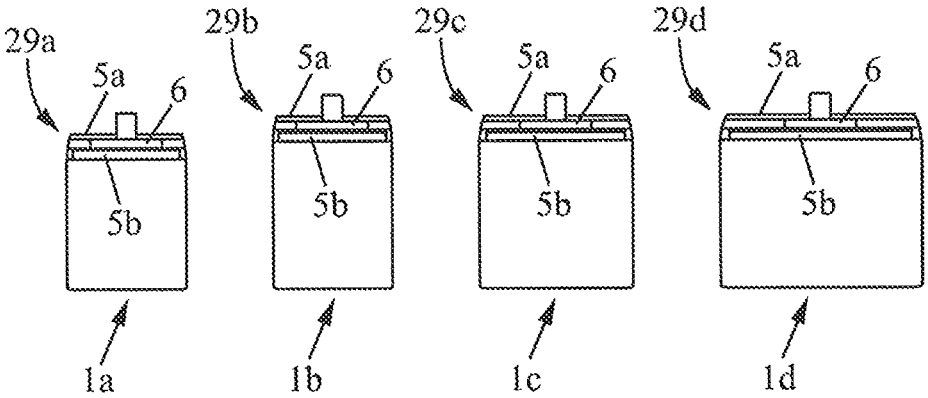
FIG. 10 is a schematic view of a range of containers.

In one embodiment, as represented in FIG. 10, a range of container components 29*a*, 29*b*, 29*c*, 29*d* are provided having housings of various sizes, in particular of different lateral extensions, and having printed circuit boards of identical dimensions, the waveguides of the various container components being of different lengths. This will allow creating printed circuit boards which are all identical, and adapting the shape of the housing to the shape of the receptacle only in the housing. This allows a single printed circuit board production line for different products. Such a system is of interest in cosmetics, where it is common to have containers 1*a*, 1*b*, 1*c*, 1*d* for the same content in different volumes and/or shapes.

Alternatively, it may be provided that for some containers the inner part 5*b* has more than eight waveguides 8, for example sixteen waveguides, and the printed circuit board has the same number of light sources. Alternatively, the microcontroller may be programmed differently depending on the container. When each light source is facing a waveguide, the microcontroller is programmed to control all light sources. In products where some light sources are not facing a waveguide, the microcontroller is programmed not to control those. It can thus be arranged that all printed circuit boards in the range of products comprise a specific number of light sources, but for some products in the range some of the sources do not receive commands.

Independently of the invention as initially claimed, the present application appears to include several other protectable inventions which the applicant reserves the right to protect at a later time by the legal mechanisms in effect, as it is apparent to the skilled person that this other invention can be implemented independently of the initially claimed invention.

For example, a container component is provided, the container 1 comprising a receptacle 2, the container component comprising:

- a housing 5 defining an inner space V,
- at least one electronic component 16 arranged within the inner space,
- at least one electrode 18 carried by a surface, in particular an outer surface 19, of the housing, adapted to control the electronic component 16.

The electronic component 16 can control the lighting, as described above, but can alternatively offer other functions such as the emission of sound, telecommunications, etc.

In this case, according to some particular embodiments:

- the electrode 18 is electrically connected to a power source 9*a*, 9*b* so as to be brought to a non-zero potential, and in particular the power source 9*a*, 9*b* is arranged in the inner space V, the electrode 18 being electrically connected to the power source 9*a*, 9*b* by a through-hole 20 in a wall of the housing;
- the electrode 18 is a first electrode, and forms with a second electrode 21 a capacitive sensor, the second electrode 21 being carried by the housing, in particular by a surface of the housing, in particular by an outer surface 19 of the housing, and being electrically connected to the electronic component 6;
- the housing 5 comprises an outer part 5*a* and an inner part 5*b* assembled together and defining the inner space V between them, and the first and second electrodes 18, 21 are carried at least partially by an outer surface of the outer part 5*a;*
- the outer part 5*a* is a thin shell comprising an edge, and the second electrode 21 is also at least partially carried by an inner surface 11 and by the edge.

According to another example, a container component is provided, the container 1 comprising a receptacle 2, the container component comprising:

- a housing 5 defining an inner space V,
- an electronic component 16 arranged within the inner space,
- an activation system 22 adapted to take a disabled state preventing activation of the electronic component 16 and an active state permitting activation of the electronic component 16, wherein the activation system 22 comprises a photodetector adapted to detect a brightness level, and to change from the disabled state to the active state above a certain detected brightness threshold.

With these arrangements, the power consumption of the container component is reduced before it is unwrapped from its packaging.

In this case, according to some particular embodiments:

the activation system (22) is arranged in the inner space (V) and is mechanically inaccessible;

the activation system (22) is adapted to change only once from the disabled state to the active state; and the container component further comprises a power source (9*a*, 9*b*) connected to the activation system (22), and adopted to supply power to die activation system (22) when said system is in its inhibited state.

The invention claimed is:

1. A container comprising a base portion, by means of which the container is adapted to rest on a support in a nominal configuration, the container comprising:

a receptacle comprising an outer wall visible from outside the container when the container is in its nominal configuration, the peripheral outer wall comprising a translucent layer, a housing defining an inner space, an electronic circuit comprising at least one light source emitting in a main emission direction, the light source being offset relative to the translucent layer, the electronic circuit being arranged within the inner space, and at least one waveguide arranged facing the at least one light source so as to guide a light wave emitted by the at least one light source into the translucent layer, wherein the electronic circuit comprises a printed circuit board carrying the at least one light source, and wherein the printed circuit board comprises a central opening.

2. The container according to claim 1, wherein the housing comprises an outer part defining the inner space.

3. The container according to claim 2, wherein the housing further comprises an inner part assembled to the outer part, the inner part being interposed between the outer part and the receptacle, the at least one waveguide being part of the inner part.

4. The container according to claim 1, wherein the receptacle comprises an end wall transverse to the outer wall, and wherein the at least one waveguide is part of the end wall.

5. The container according to claim 1, wherein the outer part is opaque.

6. The container according to claim 1, further comprising at least one power source connected to the at least one light source and adapted to supply power to the light source.

7. The container according to claim 6, wherein the housing comprises reliefs projecting from an inner surface and laterally defining a seat for the power source.

8. The container according to claim 1, wherein the housing comprises a resilient member adapted to bias the printed circuit board into abutment in the inner space.

9. The container according to claim 1, wherein the printed circuit board supports a logic circuit that is adapted to control at least one, in particular a plurality of, illumination sequences of the at least one light source, and is connected to the at least one light source.

10. The container according to claim 9, further comprising at least one power source connected to the at least one light source and adapted to supply power to the light source, wherein the logic circuit comprises a microcontroller and wherein the power source is connected to the electronic circuit and is adapted to power the microcontroller.

11. The container according to claim 9, wherein the logic circuit is adapted to define, for each light source and in a correlated manner for at least two light sources, one or more of the following characteristics, possibly variable over time:

an illumination start time, an illumination end time, an illumination duration, an illumination spectrum, an illumination intensity.

12. The container according of claim 9, further comprising a sensor system adapted to determine a parameter and to transmit a value of this parameter to the logic circuit, and wherein the logic circuit is adapted to control an illumination sequence according to the value of this parameter.

13. The container according to claim 12, wherein the sensor system comprises at least one sensor from the following list:

one or more inertial sensors adapted to detect a movement of the container, one or more capacitive sensors adapted to detect a presence near the capacitive sensor, one or more contact sensor adapted to detect a contact between two elements, in particular via a flexible tab of a printed circuit board of the electronic circuit, one or more photodetectors, adapted to detect a characteristic relating to the brightness around the container.

14. The container according to claim 12, wherein the sensor system comprises an electrode carried by the housing, in particular by an outer surface of the housing.

15. The container according to claim 14, wherein the electrode is electrically connected to a power source so as to be brought to a reference potential.

16. The container according to claim 14, wherein the electrode is a first electrode, and wherein the sensor system comprises a capacitive sensor comprising the first electrode and a second electrode carried by the housing, in particular by an outer surface of the housing, and electrically connected to the printed circuit board.

17. The container according to claim 1, comprising an activation system adapted to take a disabled state preventing activation of the at least one light source, and an active state permitting activation of the at least one light source.

18. The container according to claim 1, wherein the printed circuit board comprises a thin substrate having a polygonal outer radial periphery, particularly regular polygonal, more particularly hexagonal or octagonal.

19. The container according to one of claim 1, wherein the printed circuit board comprises a thin annular substrate having a central opening provided with a radially inner edge.

20. The container according to claim 19, wherein the printed circuit board further comprises a tab extending into the central opening from the radially inner edge, and wherein the tab carries a source light.

21. The container according to claim 1, wherein the housing has an annular shape and a through-opening.

22. The container according to claim 1, wherein the container comprising a plurality of light sources that are distributed, in particular uniformly distributed, along the periphery of the printed circuit board particularly on one face of the printed circuit board.

23. The container according to claim 1, comprising a plurality of waveguides, one per activatable light source.

24. The container according to claim 1, wherein the waveguide opens into the translucent layer, the waveguide being adapted to direct light into the translucent layer, the translucent layer being adapted to guide the light longitudinally along its thickness.

25. The container according to claim 1, wherein the housing is fixedly attached to the receptacle.

26. The container according to claim 1, wherein the outer wall of the receptacle comprises an outer surface having at least one opaque region and at least one translucent region.

27. A container comprising a base portion, by means of which the container is adapted to rest on a support in a nominal configuration, the container comprising:

a receptacle comprising an outer wall visible from outside the container when the container is in its nominal configuration, the peripheral outer wall comprising a translucent layer, a housing defining an inner space, an electronic circuit comprising a plurality of light sources emitting in a main emission direction, the light source being offset relative to the translucent layer, the electronic circuit being arranged within the inner space, at least one waveguide arranged facing the plurality of light sources so as to guide a light wave emitted by the plurality of light sources into the translucent layer, wherein the electronic circuit comprises a printed circuit board, wherein each of the plurality of light sources is formed as a LED mounted on a face of the printed circuit board, and wherein the printed circuit board comprises a central opening.

28. The container according to claim 27, wherein the plurality of LEDs are distributed and arranged annularly on one face of the printed circuit board.

29. The container according to claim 27, wherein each of the plurality of light sources is formed as surface mounted device LED.

* * * * *